US007954523B2

(12) United States Patent
Liu

(10) Patent No.: US 7,954,523 B2
(45) Date of Patent: Jun. 7, 2011

(54) CUTTER HEAD ASSEMBLY FOR A WOOD PLANING MACHINE

(75) Inventor: Chin-Yuan Liu, Taichung (TW)

(73) Assignee: Shinmax Industry Co., Ltd., Taichung Hsien (TW)

( * ) Notice: Subject to any disclaimer, the term of this patent is extended or adjusted under 35 U.S.C. 154(b) by 125 days.

(21) Appl. No.: 12/197,914

(22) Filed: Aug. 25, 2008

(65) Prior Publication Data

US 2009/0236010 A1 Sep. 24, 2009

(30) Foreign Application Priority Data

Mar. 20, 2008 (TW) ..... 97204764 U

(51) Int. Cl.
*B27C 1/00* (2006.01)

(52) U.S. Cl. ..... 144/218; 144/117.1; 144/118; 144/221; 144/230; 144/233; 144/235; 144/237

(58) Field of Classification Search ..... 144/117.1, 144/118, 221, 230, 218, 172, 174, 233, 235, 144/237; 407/35, 53, 67, 113; 241/101.762, 241/101.72, 242, 294, 295
See application file for complete search history.

(56) References Cited

U.S. PATENT DOCUMENTS 2,969,816 A 1/1961 Jonsa
3,292,478 A 12/1966 Hilding et al.
3,411,208 A 11/1968 Olof
3,817,305 A * 6/1974 Gibbs ..... 144/231
3,986,543 A * 10/1976 Slayton et al. ..... 144/236
4,151,869 A * 5/1979 Halloran et al. ..... 144/230
4,219,291 A * 8/1980 Hoeh ..... 407/31
4,538,655 A * 9/1985 Berkeley ..... 144/230
5,146,963 A * 9/1992 Carpenter et al. ..... 144/231
5,348,065 A * 9/1994 Meyer ..... 144/231
5,474,239 A * 12/1995 Williams et al. ..... 241/73
5,992,204 A 11/1999 Jonkka et al.
6,012,372 A 1/2000 Laster et al.
6,386,250 B1 * 5/2002 Liu ..... 144/231
6,427,572 B2 8/2002 Ciani et al.
6,659,694 B1 12/2003 Asbell et al.
6,776,203 B1 * 8/2004 Cecchi ..... 144/221
7,040,843 B1 5/2006 Martin
(Continued)

OTHER PUBLICATIONS

Non Final Office Action U.S. Appl. No. 12/470,240 Dated Sep. 7, 2010.
Non Final Office Action U.S. Appl. No. 12/470,240 dated Apr. 12, 2010.

*Primary Examiner* — Dana Ross
*Assistant Examiner* — Jennifer Chiang
(74) *Attorney, Agent, or Firm* — Stephen A. Bent; Foley & Lardner LLP

(57) ABSTRACT

A cutter head assembly for a wood planing machine includes a shaft, a plurality of cutter-mounting sleeve modules sleeved on the shaft, and a plurality of cutter modules respectively secured to the sleeve modules such that cutting edges of the cutter modules extend beyond outer wall surfaces of the sleeve modules. An angularly variable positioning mechanism includes an axially extending guiding member disposed on the mount segment, and a plurality of axially extending guided members disposed on inner wall surfaces of the sleeve modules to mate with the axially guiding member. By virtue of fitting engagement between the guiding member and a selected one of the guided member of each sleeve module that are sequentially sleeved onto the shaft, the cutting edges together define a cutting contour line that winds around the shaft.

9 Claims, 10 Drawing Sheets

U.S. PATENT DOCUMENTS 7,051,776 B2 5/2006 Liu
7,055,770 B2 * 6/2006 Bardos ..... 241/189.1
7,390,151 B2 * 6/2008 Martin et al. ..... 407/49
7,410,330 B1 * 8/2008 Tsai ..... 407/35

* cited by examiner

CUTTER HEAD ASSEMBLY FOR A WOOD PLANING MACHINE

CROSS-REFERENCE TO RELATED APPLICATION

This application claims priority of Taiwanese patent Application No. 097204764, filed on Mar. 20, 2008.

BACKGROUND OF THE INVENTION

1. Field of the Invention

This invention relates to a cutter head assembly for a wood planing machine, more particularly to a modular cutter head assembly which constitutes a cutting contour line winding around a shaft.

2. Description of the Related Art

Referring to FIG. 1, a conventional cutter head assembly for a wood planing machine 10 is shown to have a spiral cutting contour which is constituted by a plurality of blade segments 13 so as to improve quality of wood products. The blade segments 13 are respectively secured to a plurality of blade mounting blocks 122 formed on an outer surrounding surface 121 of a shaft 12 by means of screw fasteners 14. The shaft 12 is driven by a transmitting axle 11 to rotate the blade segments 13 so as to perform a planing process. However, since the blade mounting blocks 122 are integrally formed with the shaft 12, are respectively formed with screw holes 123, and are required to be arranged in a spiral manner, fabrication of the shaft 12 is difficult, costly and time consuming.

SUMMARY OF THE INVENTION

The object of the present invention is to provide a cutter head assembly for a wood planing machine, which is convenient and less costly to fabricate.

According to this invention, the cutter head assembly includes a shaft, a plurality of cutter-mounting sleeve modules, a plurality of cutter modules, and an angularly variable positioning mechanism. The shaft is elongated along an axis, and has two ends and a mount segment interposed therebetween. Each of the cutter-mounting sleeve modules has outer and inner wall surfaces opposite to each other in radial directions. The outer wall surface defines a slot which extends towards the inner wall surface to form a leading seat sidewall and a trailing opposing sidewall angularly spaced apart from each other by the slot. Each of the cutter modules has a cutting edge, and is secured to the leading seat sidewall such that the cutting edge extends beyond the outer wall surface. The angularly variable positioning mechanism includes a guiding member and a plurality of guided members. The guiding member is disposed on the mount segment, and extends along the axis. The guided members are disposed on the inner wall surface, and are angularly displaced from one another. Each of the guided members is configured to mate with the guiding member such that, when the cutter-mounting sleeve modules are sequentially brought to be sleeved onto the mount segment along the axis, with a selected one of the guided members in each of the cutter-mounting sleeve modules matingly engaging the guiding member, the cutting edges of the cutter-mounting sleeve modules thus sleeved on said mount segment together define a cutting contour line that winds around the mount segment angularly and axially.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
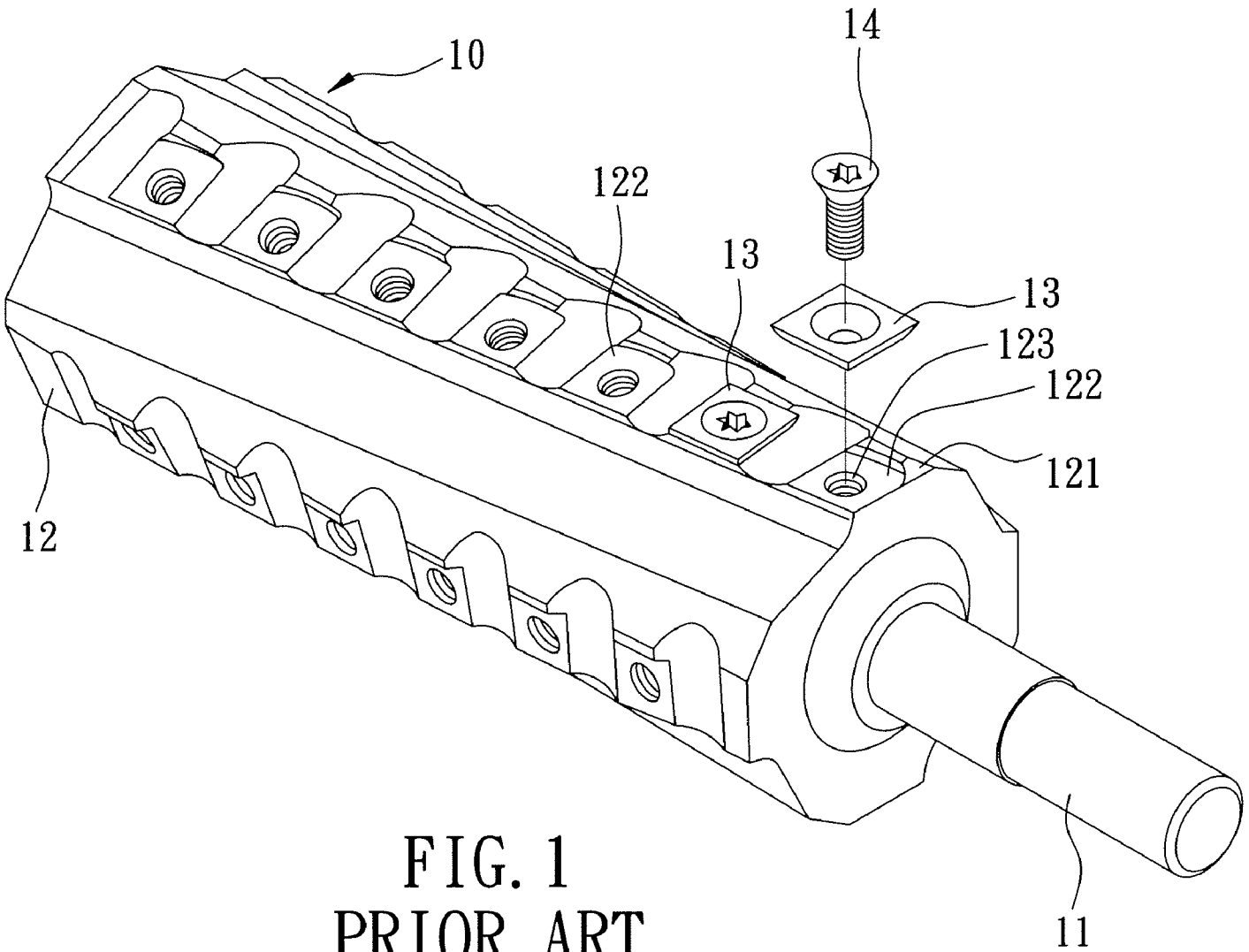
FIG. 1 PRIOR ART
FIG. 1 is a perspective view of a conventional cutter head assembly for a wood planing machine.
Figure 2:
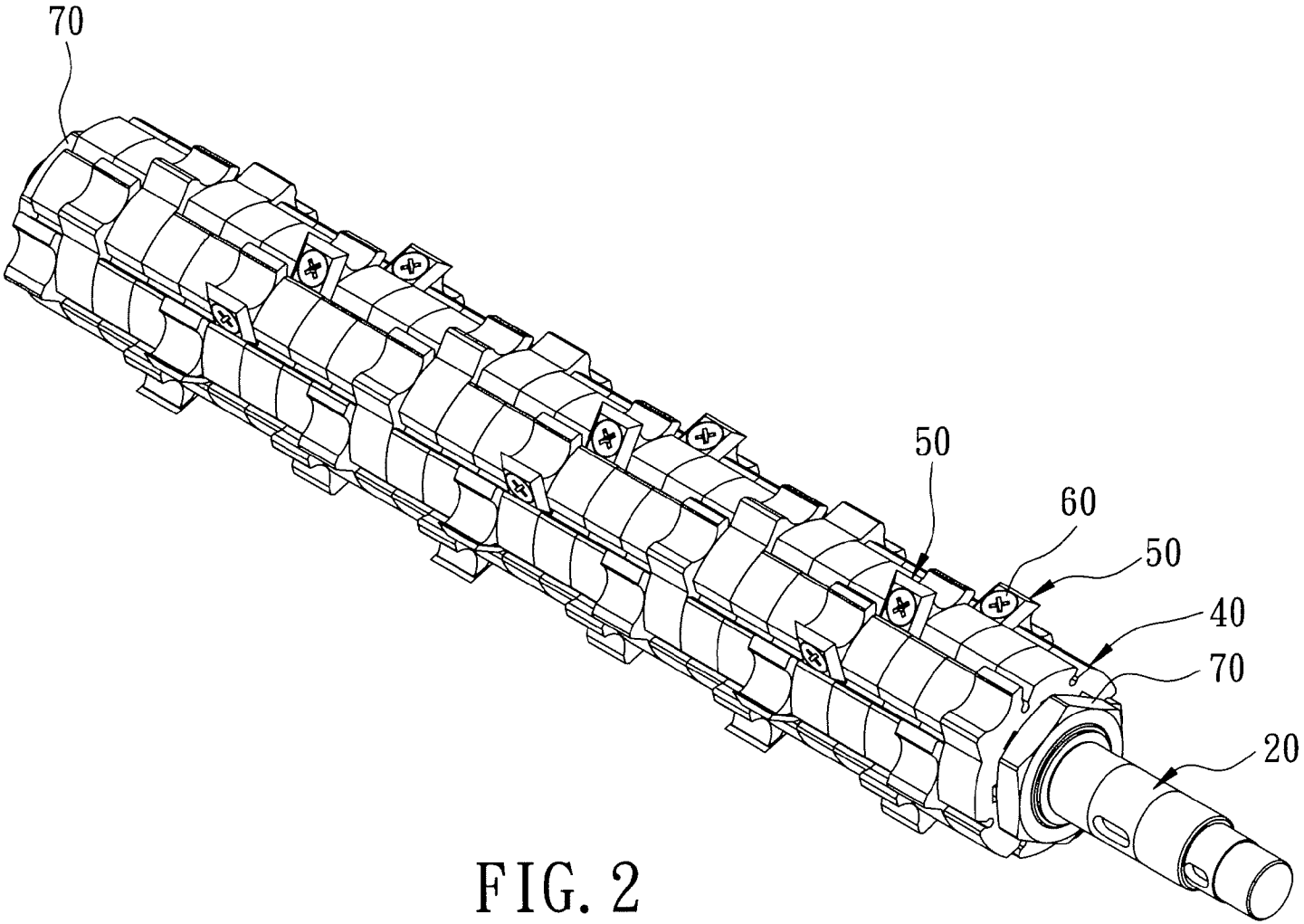
FIG. 2 is a perspective view of a preferred embodiment of a cutter head assembly for a wood planing machine according to this invention.
Figure 3:
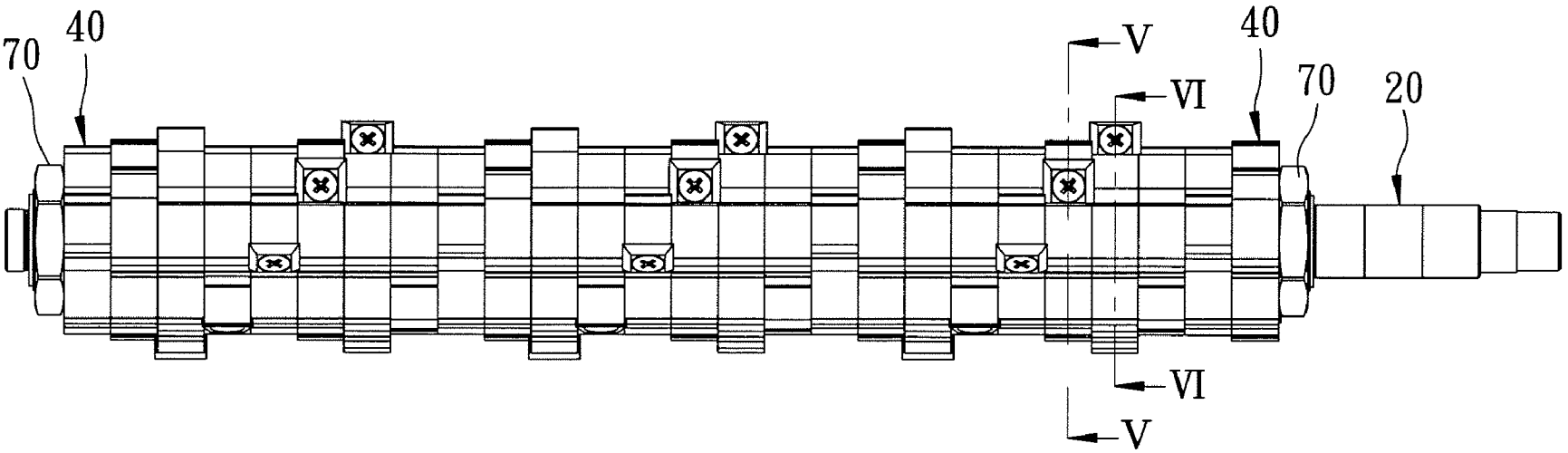
FIG. 3 is a schematic top view of the preferred embodiment.

Before the present invention is described in greater detail, it should be noted that same reference numerals have been used to denote like elements throughout the specification.

Referring to FIGS. 2 to 5, the first preferred embodiment of a cutter head assembly according to the present invention is adapted for use with a wood planing machine (not shown), and is shown to comprise a shaft 20, a plurality of cutter-mounting sleeve modules 40, a plurality of cutter modules 50, an angularly-variable positioning mechanism, and two fasteners 70.

The shaft 20 is elongated along an axis (I) in an axial direction, and has two ends 23 opposite to each other along the axis (I), and a mount segment 21 interposed between the ends 23.

Figure 4:
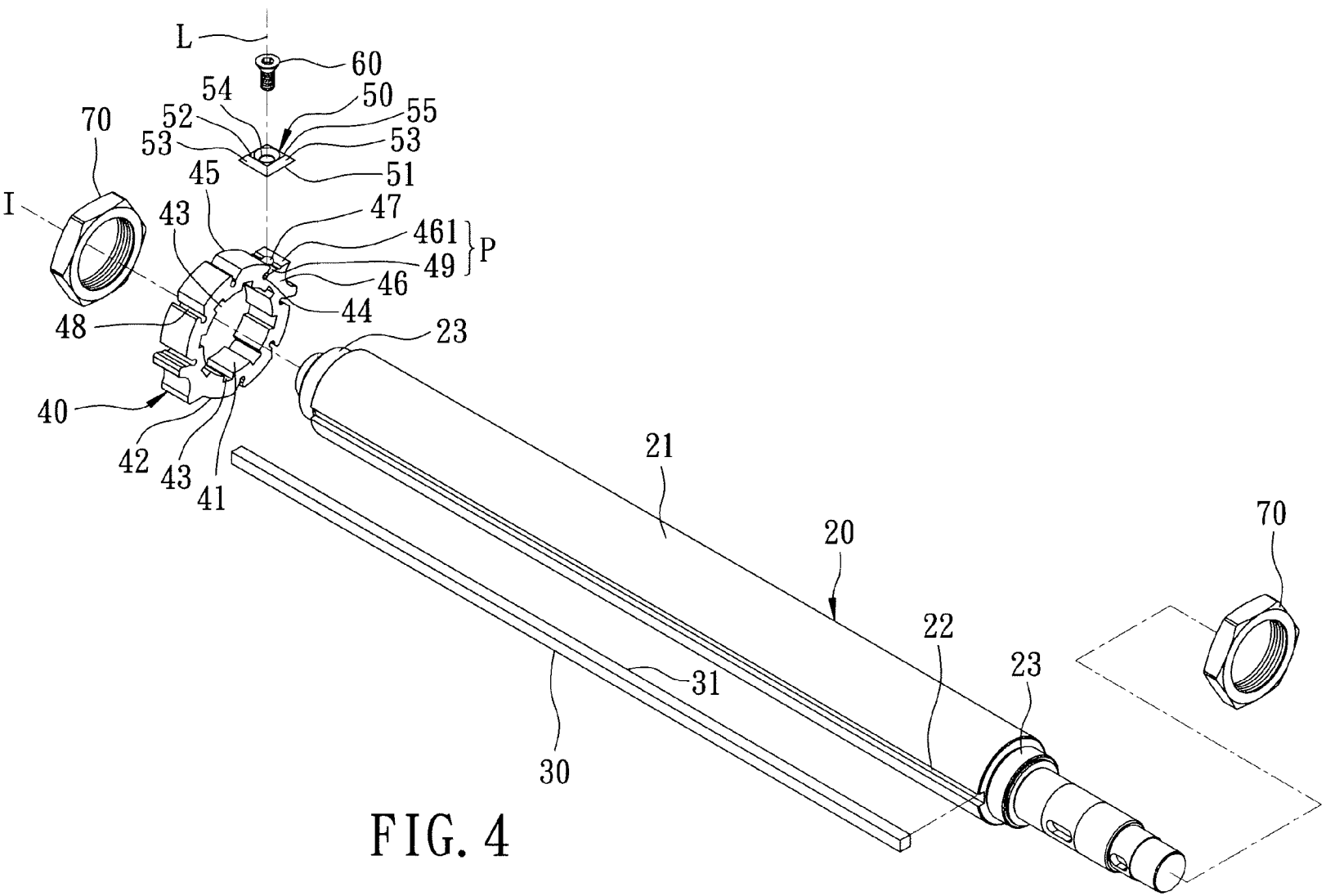
FIG. 4 is an exploded perspective view of the preferred embodiment.

Each of the cutter-mounting sleeve modules 40 (only one is shown in FIG. 4) has outer and inner wall surfaces 42,41 opposite to each other in radial directions. The outer wall surface 42 defines a slot 44 which extends towards the inner wall surface 41 to form a leading seat sidewall 49 and a trailing opposing sidewall 45 that are angularly spaced apart from each other by the slot 44. The trailing opposing sidewall 45 has an abutment surface 451 facing the slot 44. Each of the cutter-mounting sleeve modules 40 further has a raised addendum 46 which extends radially from the outer wall surface 42 adjacent to the slot 44, and which has a rest wall surface 461 extending circumferentially and towards the inner wall surface 41 such that the rest wall surface 461 is connected to and is co-planar with the leading seat sidewall 49 in an abutting plane (P). A screw hole 47 is formed to extend from the abutting plane (P).

Each of the cutter modules 50 has cutting and abutting edges 53 that are configured to be symmetric to each other with respect to a line (L) normal to the abutting plane (P). Specifically, each of the cutter modules 50 has four edges 53, two opposite ones of the edges 53 serving as the cutting and abutting edges 53. Each of the cutter modules 50 further has a central body 55 which is interposed among the edges 53, and which has inner and outer major surfaces 51,52 opposite to each other along the normal line (L). The central body 55 is formed with a through hole 54 which extends along the normal line (L) from the outer major surface 52 through the inner major surface 51. Each of the cutter modules 50 is secured to the leading seat sidewall 49 by a screw fastener 60 which passes through the through hole 54 and which is threadedly engaged with the screw hole 47 such that the inner major surface 51 is brought to abut against both the leading seat sidewall 49 and the rest wall surface 461, and such that the abutting edge 53 abuts against the abutment surface 451 so as to permit the cutting edge 53 to extend beyond the rest wall surface 461.

Figure 5:
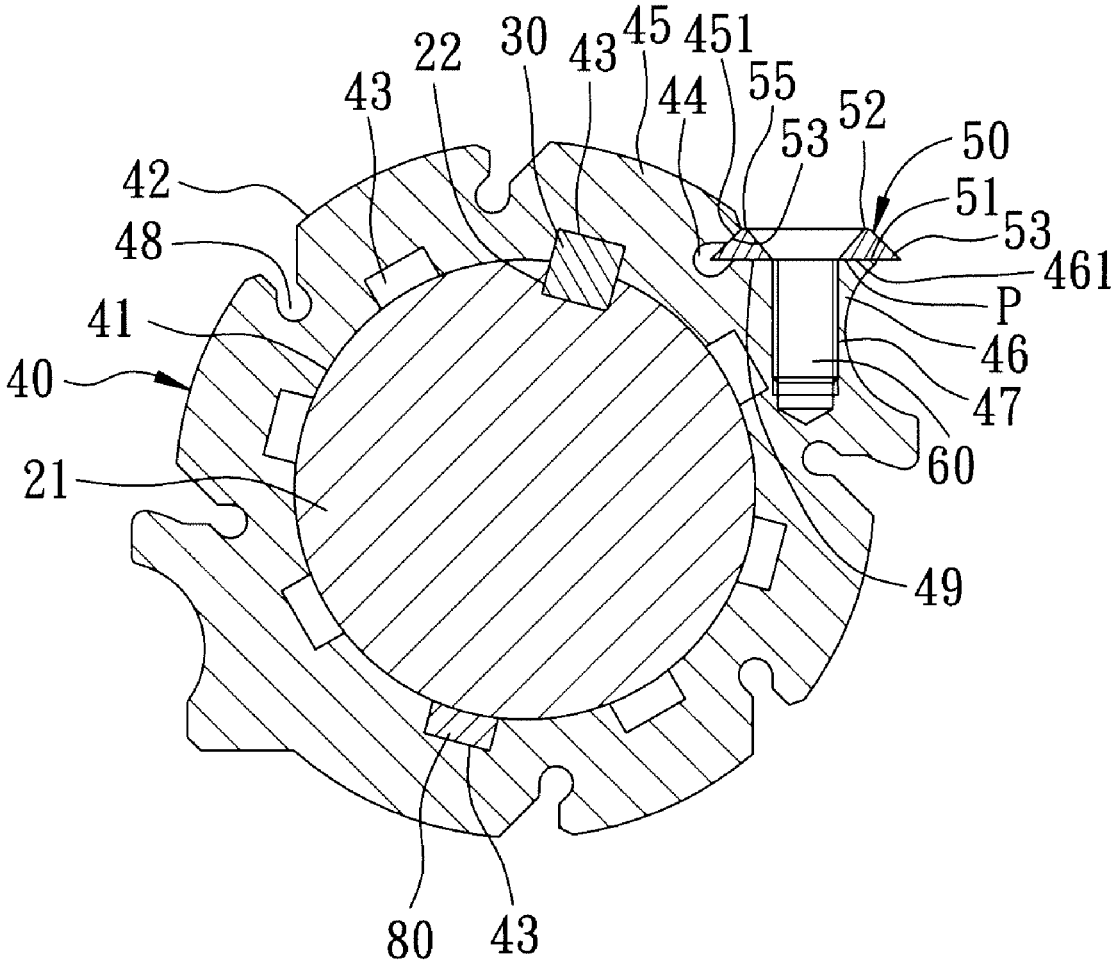
FIG. 5 is a cross-sectional view of the preferred embodiment taken along lines V-V of FIG. 3.
Figure 6:
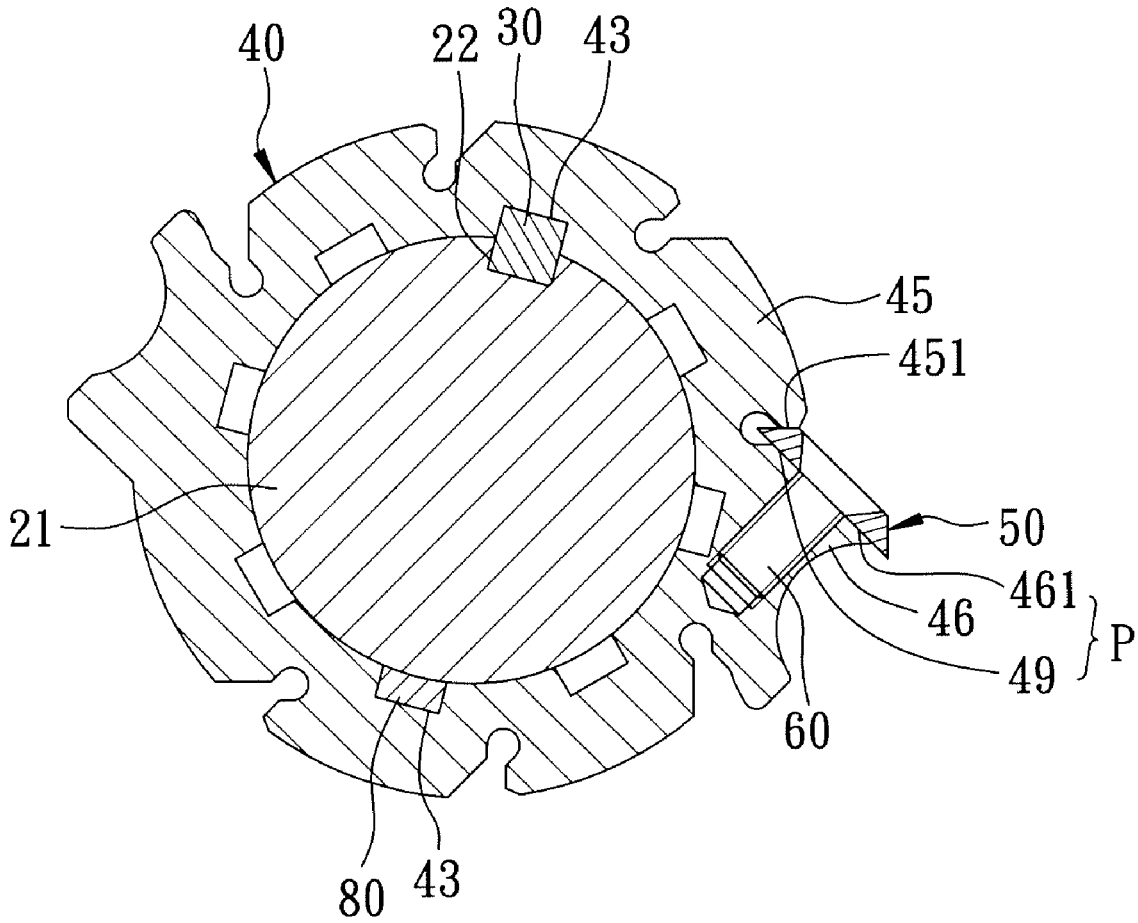
FIG. 6 is a cross-sectional view of the preferred embodiment taken along lines VI-VI of FIG. 3.

In this embodiment, as shown in FIGS. 5 and 6, a surface area of the inner major surface 51 is larger than that of the outer major surface 52. Thus, the abutment surface 451 is configured to cooperate with the abutting plane (P) to define an included angle of less than 90 degrees, such that the area of contact between the abutting edge 53 and the abutment surface 451 is increased to thereby ensure firm attachment of the cutter modules 50 to the respective sleeve modules 40. Further, the outer major surface 52 preferably defines an included angle more than 135 degrees with the cutting edge 53.

Figure 7:
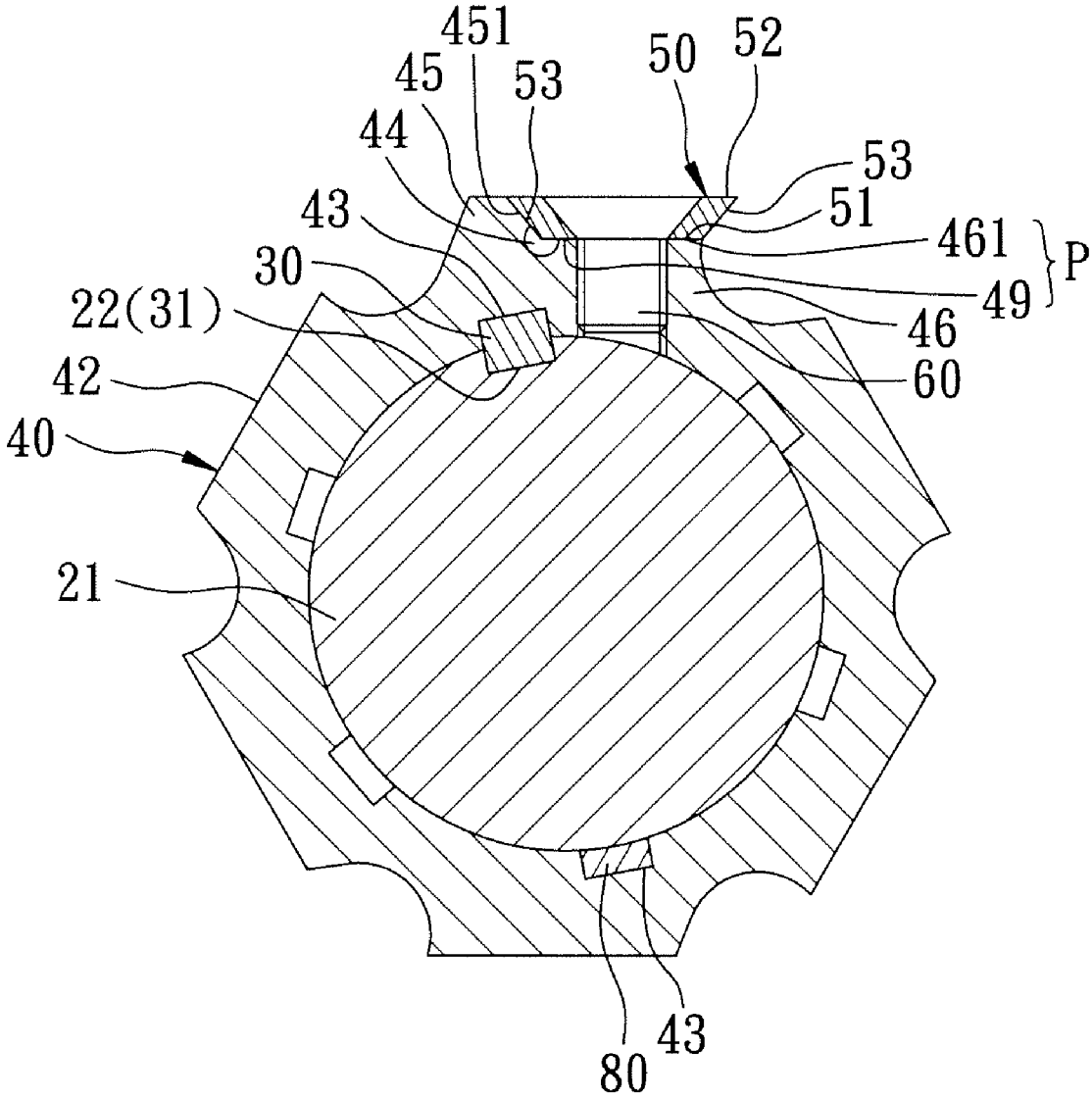
FIG. 7 is a cross-sectional view of another preferred embodiment of a cutter head assembly for a wood planing machine according to this invention.
Figure 8:
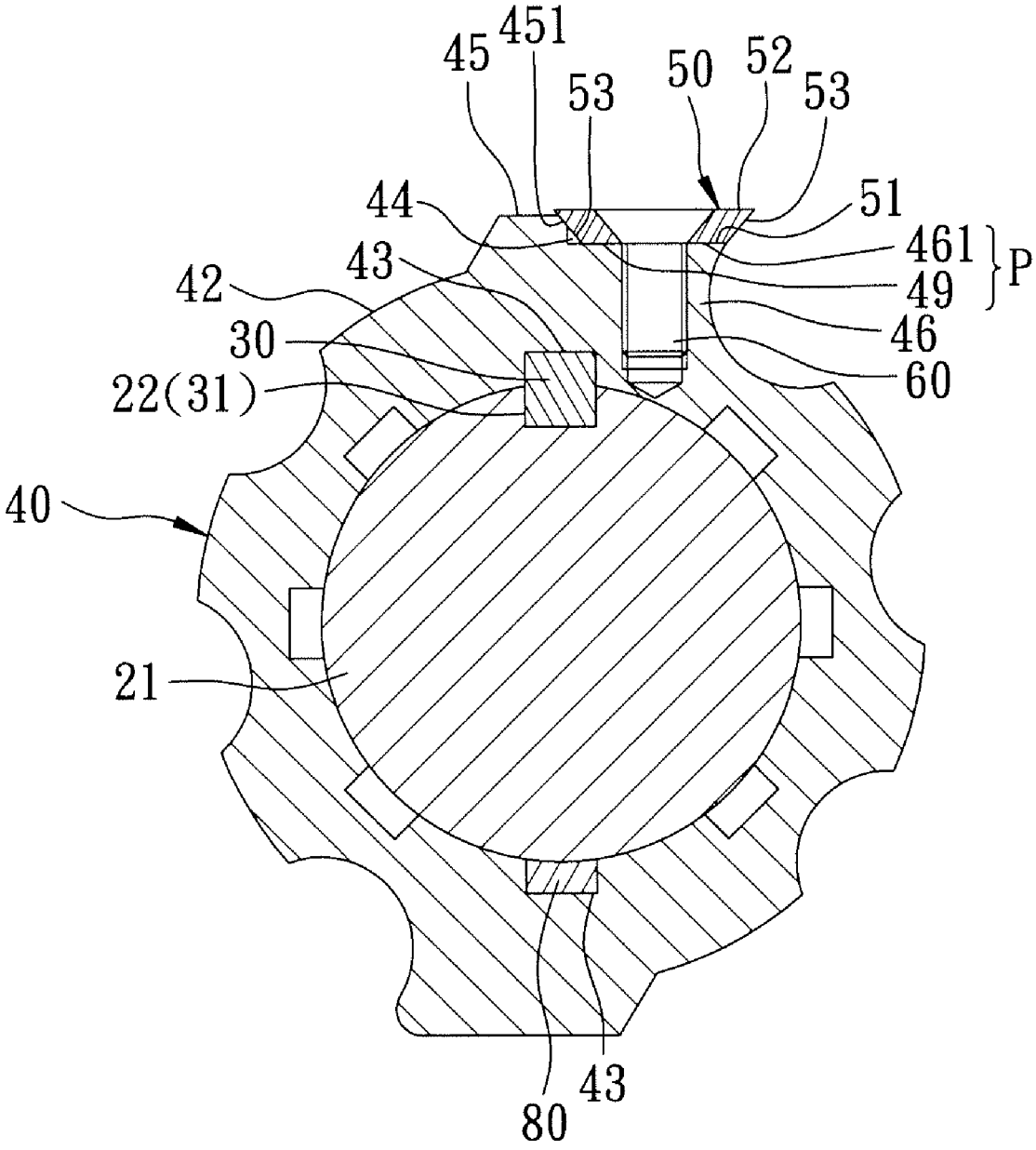
FIG. 8 is a cross-sectional view of an alternate preferred embodiment of a cutter head assembly for a wood planing machine according to this invention.

Alternatively, in the other embodiments, as shown in FIGS. 7 and 8, a surface area of the inner major surface 51 is smaller than that of the outer major surface 52. Thus, the abutment surface 451 is configured to cooperate with the abutting plane (P) to define an included angle of more than 90 degrees, e.g., 135 degrees, such that the area of contact between the abutting edge 53 and the abutment surface 451 is increased to thereby ensure firm attachment of the cutter modules 50 to the respective sleeve modules 40.

The angularly-variable positioning mechanism includes a guiding member 30 and a plurality of guided members 43.

The guiding member 30 is a guiding rail 30, and is elongated in the axial direction. In particular, the mount segment 21 is formed with an insertion groove 22 extending in the axial direction to terminate at two insertion openings that border the ends 23, respectively. The guiding rail 30 has an insertion base 31 that is configured to be insertable into the insertion groove 22 through one of the insertion openings so as to be disposed on the mount segment 21.

The guided members 43 are in the form of a plurality of guided grooves 43 which are disposed in the inner wall surface 41 of each of the cutter-mounting sleeve modules 40, which extend toward the outer wall surface 42, and which are angularly displaced from one another. Each of the guided grooves 43 is configured to mate with the guiding rail 30. The cutter-mounting sleeve modules 40 are sequentially brought to be sleeved onto the mount segment 21 along the axis (I), with a selected one of the guided grooves 43 in each of the cutter-mounting sleeve modules 40 matingly engaging the axially guiding rail 30, such that each of the cutter-mounting sleeve modules 40 is non-rotatably retained on the mount segment 21, and such that the cutting edges 53 on the cutter-mounting sleeve modules 40 thus fitted onto the mount segment 21 together define a cutting contour line that winds around the mount segment 21 angularly and axially, as shown in FIGS. 2, 3, 5 and 6.

The fasteners 70 are in the form of screw nuts 70, and are threadedly and respectively engaged with the ends 23 of the shaft 20 to guard against axial movement of the cutter-mounting sleeve modules 40 once the cutter-mounting sleeve modules 40 have been sequentially sleeved on the mount segment 21.

Preferably, the outer wall surface 42 of each of the cutter-mounting sleeve modules 40 further has a plurality of slits 48 which extend towards the inner wall surface 41 so as to reduce the weight of the sleeve modules 40. Further, in this embodiment, each of the cutter-mounting sleeve modules 40 is made by a powder metallurgy process.

Preferably, a counterweight 80 is matingly fitted in the corresponding guided groove 43 in each of the cutter-mounting sleeve modules 40 such that, once the cutter-mounting sleeve modules 40 have been sequentially sleeved on the mount segment 21, the counterweights 80 are disposed diametrically opposite to the guiding rail 30 with respect to the axis (I).

As illustrated, according to the present invention, since the components of the cutter head assembly, such as the cutter-mounting sleeve modules 40 and the cutter modules 50, have the same configurations, fabrication of the modules 40 and 50 is convenient and less costly.

Figure 9:
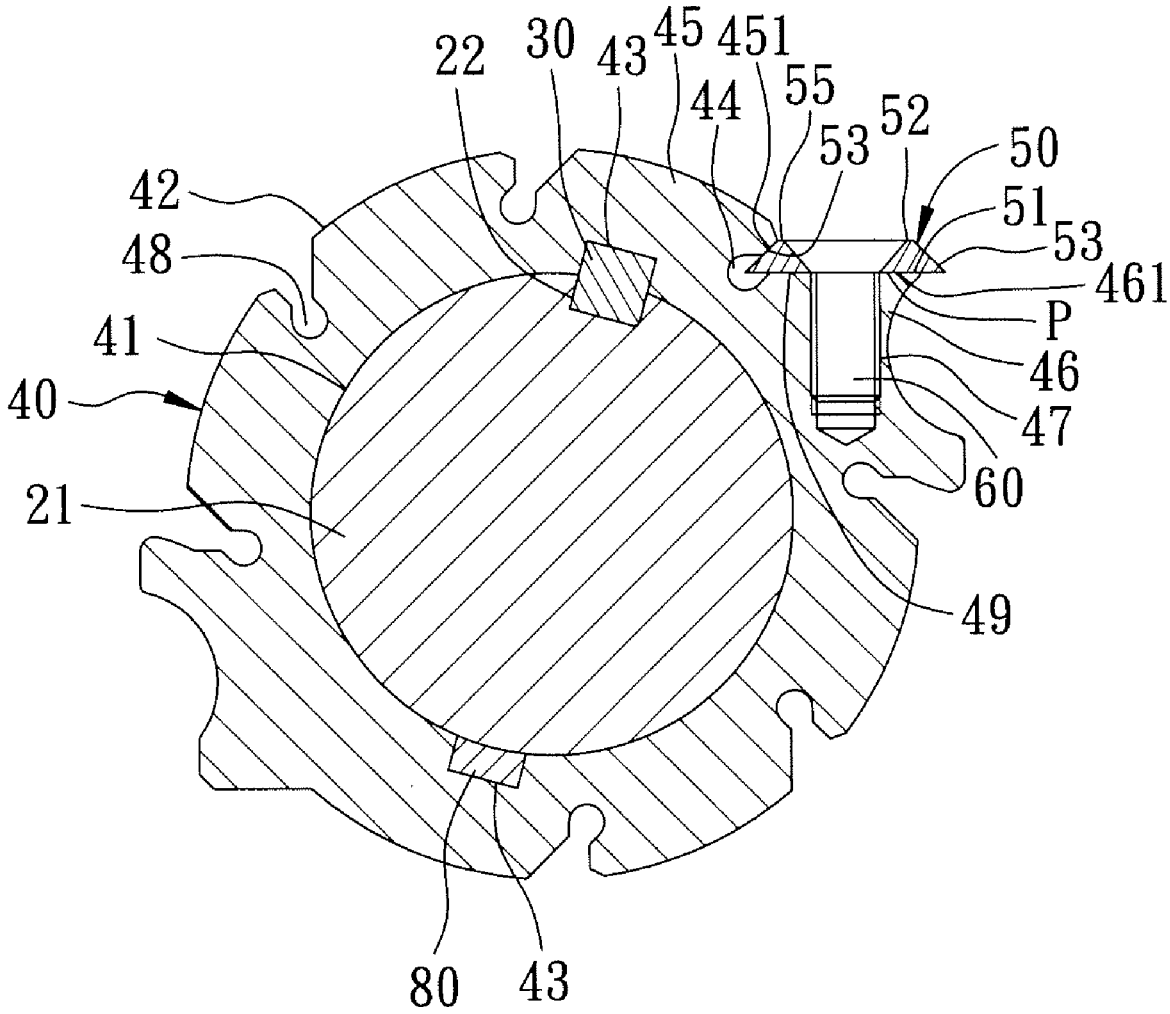
FIG. 9 is a cross-sectional view of still another preferred embodiment of a cutter head assembly for a wood planing machine according to this invention.
Figure 10:
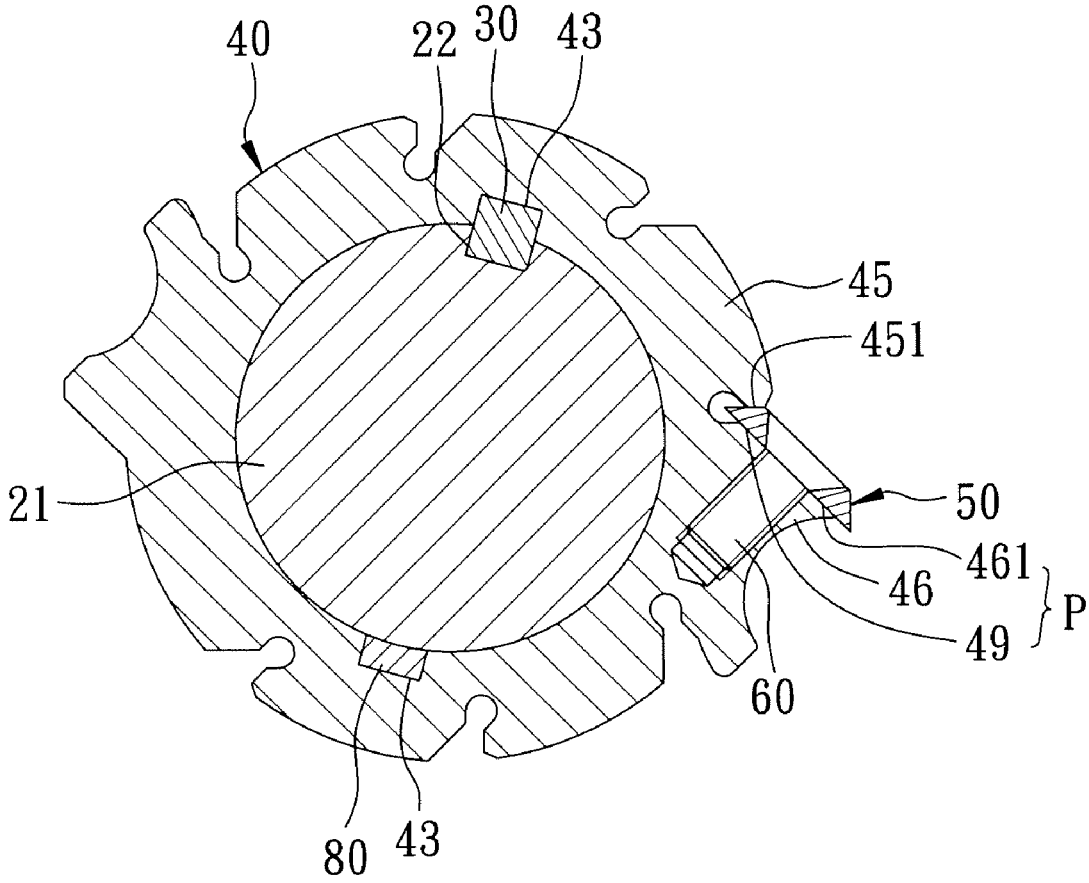
FIG. 10 is a cross-sectional view of the preferred embodiment shown in FIG. 9, but taken from another cutter-mounting sleeve module.

Referring to FIGS. 9 and 10, in still another embodiment according to this invention, two opposite guided grooves 43 are disposed in the inner wall surface 41 of each of the cutter-mounting sleeve modules 40, and are arranged at a predetermined angular position relative to the corresponding cutter module 50. When the cutter-mounting sleeve modules 40 are sequentially brought to be sleeved onto the mount segment 21 along the axis (I), with one of the guided grooves 43 of each cutter-mounting sleeve module 40 matingly engaging the guiding rail 30, the cutting edges 53 on the cutter-mounting sleeve modules 40 thus sleeved on the mount segment 21 together define a cutting contour line that winds around the mount segment 21 angularly and axially.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A cutter head assembly for a wood planing machine, comprising:

a shaft which is elongated along an axis in an axial direction, and which has two ends opposite to each other along the axis, and a mount segment that is interposed between said ends;

a plurality of cutter-mounting sleeve modules, each having outer and inner wall surfaces opposite to each other in radial directions, said outer wall surface defining a slot which extends towards said inner wall surface to form a leading seat sidewall and a trailing opposing sidewall that are angularly spaced apart from each other by said slot, said trailing opposing sidewall having an abutment surface facing said slot, each of said cutter-mounting sleeve modules including a raised addendum which extends radially from said outer wall surface adjacent to said slot, and which has a rest wall surface extending circumferentially and towards said inner wall surface such that said rest wall surface is connected to and is co-planar with said leading seat sidewall in an abutting plane;

a plurality of cutter modules, each having a cutting edge and an abutting edge opposite to said cutting edge, each of said cutter modules being secured to said leading seat sidewall of a respective one of said cutter-mounting sleeve modules such that said cutting edge extends beyond said outer wall surface of the respective one of said cutter-mounting sleeve modules, and said abutting edge abuts against said abutment surface when a respective one of said cutter modules is secured to said leading seat sidewall, each of said cutter modules including a central body which is interposed between said cutting edge and said abutting edge, and which has inner and outer major surfaces opposite to each other along a line that is normal to the abutting plane such that, when each of said cutter modules is secured to said leading seat sidewall, said inner major surface is brought to abut against both said leading seat sidewall and said rest wall surface so as to permit said cutting edge to extend beyond said rest wall surface; and an angularly-variable positioning mechanism including a guiding member disposed on said mount segment and extending along the axis, and a plurality of guided members which extend axially, which are disposed on said inner wall surface, and which are angularly displaced from one another, each of said guided members being configured to mate with said guiding member such that said cutter-mounting sleeve modules are non-rotatably retained on said mount segment along the axis, and such that, when said cutter-mounting sleeve modules are sequentially brought to be sleeved onto said mount segment along the axis, with a selected one of said guided members in each of said cutter-mounting sleeve modules matingly engaging said axially guiding member, said cutting edges on said cutter-mounting sleeve modules thus sleeved on said mount segment together define a cutting contour line that winds around said mount segment angularly and axially.

2. The cutter head assembly according to claim 1, wherein said guiding member is a guiding rail which is elongated in the axial direction, and is disposed on said mount segment, said guided members being in form of a plurality of guided grooves which extend toward said outer wall surface.

3. The cutter head assembly according to claim 2, wherein said mount segment is formed with an insertion groove that extends in the axial direction to terminate at an insertion opening that borders one of said ends, said guiding rail having an insertion base configured to be insertable into said insertion groove through said insertion opening so as to be disposed on said mount segment.

4. The cutter head assembly according to claim 1, wherein said abutting edge is configured to have a shape which is symmetric to said cutting edge with respect to the normal line, said abutment surface cooperating with said abutting plane to define an included angle of less than 90 degrees.

5. The cutter head assembly according to claim 1, wherein said abutting edge is configured to have a shape which is symmetric to said cutting edge with respect to the normal line, said abutment surface cooperating with said abutting plane to define an included angle of 135 degrees.

6. The cutter head assembly according to claim 1, further comprising two fasteners which are releasably and respectively secured to said ends of said shaft to guard against axial movement of said cutter-mounting sleeve modules after said cutter-mounting sleeve modules have been sequentially sleeved onto said mount segment.

7. The cutter head assembly according to claim 6, wherein said fasteners are threadedly engaged with said ends of said shaft.

8. The cutter head assembly according to claim 2, further comprising a plurality of counterweights, each being matingly fitted in a corresponding one of said guided grooves such that, once said cutter-mounting sleeve modules have been sequentially sleeved onto said mount segment, said counterweights are disposed to be diametrically opposite to said axially guiding rail with respect to the axis.

9. A cutter head assembly for a wood planing machine, comprising:

a shaft which is elongated along an axis in an axial direction, and which has two ends opposite to each other along the axis, and a mount segment that is interposed between said ends;

a guiding rail disposed on said mount segment and extending along the axis;

a plurality of cutter-mounting sleeve modules, each having outer and inner wall surfaces opposite to each other in radial directions, said outer wall surface defining a slot which extends towards said inner wall surface to form a leading seat sidewall and a trailing opposing sidewall that are angularly spaced apart from each other by said slot, said trailing opposing sidewall having an abutment surface facing said slot, each of said cutter-mounting sleeve modules including a raised addendum which extends radially from said outer wall surface adjacent to said slot, and which has a rest wall surface extending circumferentially and towards said inner wall surface such that said rest wall surface is connected to and is co-planar with said leading seat sidewall in an abutting plane;

a plurality of cutter modules, each having a cutting edge and an abutting edge opposite to said cutting edge, each of said cutter modules being secured to said leading seat sidewall of a respective one of said cutter-mounting sleeve modules such that said cutting edge extends beyond said outer wall surface of the respective one of said cutter-mounting sleeve modules, and said abutting edge abuts against said abutment surface when a respective one of said cutter modules is secured to said leading seat sidewall, each of said cutter modules including a central body which is interposed between said cutting edge and said abutting edge, and which has inner and outer major surfaces opposite to each other along a line that is normal to the abutting plane such that, when each of said cutter modules is secured to said leading seat sidewall, said inner major surface is brought to abut against both said leading seat sidewall and said rest wall surface so as to permit said cutting edge to extend beyond said rest wall surface; and a plurality of guided grooves which extend axially, which are respectively disposed in said inner wall surfaces of said cutter-mounting sleeve modules, and which are configured to mate with said guiding rail such that said cutter-mounting sleeve modules are non-rotatably retained on said mount segment along the axis, and such that, when said cutter-mounting sleeve modules are sequentially brought to be sleeved onto said mount segment along the axis, with said guided grooves matingly engaging said guiding rail, said cutting edges on said cutter-mounting sleeve modules thus sleeved on said mount segment together define a cutting contour line that winds around said mount segment angularly and axially.

* * * * *